US008403530B2

(12) United States Patent
Singer et al.

(10) Patent No.: US 8,403,530 B2
(45) Date of Patent: Mar. 26, 2013

(54) LED SPOTLIGHT INCLUDING ELLIPTICAL AND PARABOLIC REFLECTORS

(75) Inventors: Jeffrey M. Singer, Springfield, OH (US); David Barnett, Urbana, OH (US); Scott R. Mangum, Dublin, OH (US)

(73) Assignee: Honeywell International Inc., Morristown, NJ (US)

( * ) Notice: Subject to any disclaimer, the term of this patent is extended or adjusted under 35 U.S.C. 154(b) by 44 days.

(21) Appl. No.: 12/887,379

(22) Filed: Sep. 21, 2010

(65) Prior Publication Data

US 2012/0069562 A1 Mar. 22, 2012

(51) Int. Cl.
*F21V 13/02* (2006.01)

(52) U.S. Cl. ..... 362/243; 362/240; 362/241; 362/247; 362/249.02; 362/304

(58) Field of Classification Search ..... 362/516–519, 362/157, 240, 241, 242, 243, 247, 249.02, 362/298, 302, 304, 346, 235, 296.01
See application file for complete search history.

(56) References Cited

U.S. PATENT DOCUMENTS

| | | | | |
|---|---|---|---|---|
| 1,935,729 | A | 11/1933 | Rosenbaum | |
| 5,851,063 | A | 12/1998 | Doughty et al. | |
| 6,636,003 | B2 * | 10/2003 | Rahm et al. | 315/179 |
| 6,806,659 | B1 | 10/2004 | Mueller et al. | |
| 7,288,902 | B1 | 10/2007 | Melanson | |
| 7,438,447 | B2 | 10/2008 | Holder et al. | |
| 7,527,390 | B2 * | 5/2009 | Kakuta | 362/247 |
| 7,604,385 | B2 | 10/2009 | Albou | |
| 7,645,053 | B2 * | 1/2010 | Machi et al. | 362/241 |
| 2003/0231494 | A1 * | 12/2003 | Shimokawa et al. | 362/245 |
| 2004/0264193 | A1 | 12/2004 | Okumura | |
| 2005/0094402 | A1 * | 5/2005 | Albou | 362/297 |
| 2007/0291467 | A1 | 12/2007 | Nagai et al. | |
| 2008/0019136 | A1 | 1/2008 | Mertens et al. | |
| 2010/0020538 | A1 * | 1/2010 | Schulz et al. | 362/235 |
| 2010/0091507 | A1 * | 4/2010 | Li et al. | 362/470 |
| 2011/0090681 | A1 * | 4/2011 | Hobson et al. | 362/217.05 |
| 2011/0235322 | A1 * | 9/2011 | Fields et al. | 362/230 |

* cited by examiner

*Primary Examiner* — Ismael Negron
(74) *Attorney, Agent, or Firm* — Lowe Graham Jones PLLC

(57) ABSTRACT

One or more layers of LEDs shine light into an array of elliptical reflectors. Each elliptical reflector has an LED at one focal point and shares the second focal point with a larger parabolic reflector that collimates the light. A hole in the center of the parabolic reflector receives additional LEDs, with or without collimation optics.

16 Claims, 7 Drawing Sheets

LED SPOTLIGHT INCLUDING ELLIPTICAL AND PARABOLIC REFLECTORS

BACKGROUND OF THE INVENTION

Light Emitting Diode (LED) technology offers advantages in efficiency and life over traditional incandescent or halogen lights. Typical LED lamp design approaches use a planar array of LEDs with one or more collimating optics to achieve the desired photometric distribution. Many LED lamps used as alternatives to Parabolic Aluminized Reflector (PAR) lamps cannot match the photometric performance for a given frontal area compared to the conventional lamps they would replace, particularly for applications that require very high peak intensities such as a PAR64 aircraft landing light or an entertainment stage light.

SUMMARY OF THE INVENTION

Instead of a simple forward facing planar array that might typically be used for a PAR lamp replacement, the present invention uses depth of the package to increase the total peak intensity. One or more layers of LEDs shine into an array of elliptical reflectors. Each elliptical reflector has an LED at one focal point and shares the second focal point with a larger parabolic reflector that collimates the light. The resulting system has a hole in the center of the parabolic reflector where additional layers of LEDs, with or without collimation optics, are placed to further increase the intensity of the system. This configuration allows the distribution to be adjusted for the application (wavelength, peak intensity and beam spread) by changing the number or type of LED, the focal lengths of the ellipses, the parabola and the collimation optics.

In one aspect of the invention, the LEDs are separated to distribute the thermal load over a larger surface area for higher power applications.

In still another aspect of the invention, dual-mode capability within the same footprint is provided by replacing some of the visible LEDs with Infrared (IR) LEDs and modifying the drive electronics to control those IR LEDs separately.

In yet another aspect of the invention, the system provides variable color output by appropriate placement of various colored LEDs (e.g., red, green, blue, amber and/or white) and separate drive electronics for each group of colored LEDs to allow for color mixing.

BRIEF DESCRIPTION OF THE DRAWINGS

Preferred and alternative embodiments of the present invention are described in detail below with reference to the following drawings.

DETAILED DESCRIPTION OF THE INVENTION

Figure 1:
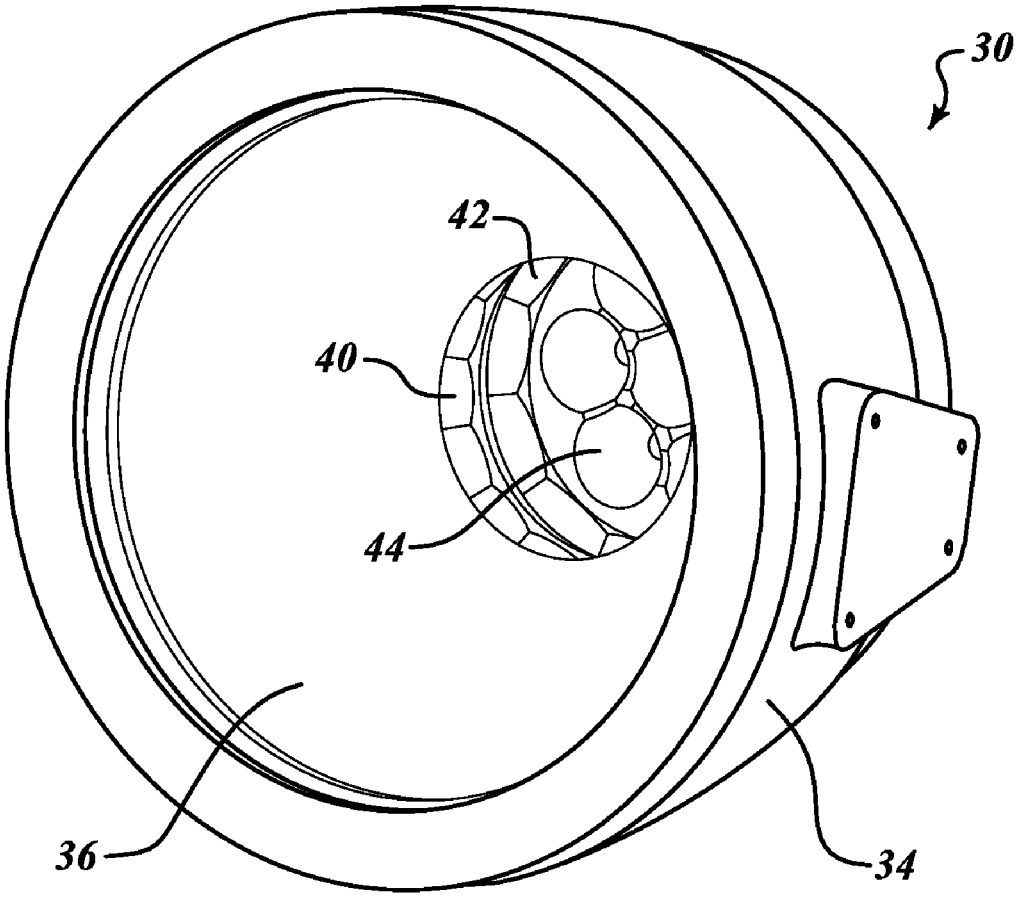
FIG. 1 illustrates a perspective view of a light assembly formed in accordance with an embodiment of the present invention.

FIG. 1 illustrates a perspective view of a light assembly 30 formed in accordance with an embodiment of the present invention. The light assembly 30 is capable of producing a greater intensity of light than that produced by conventional light emitting diode (LED) light assemblies of comparable anterior dimension. The light assembly 30 includes a housing 34 which is capped at one end by a lens 58. Inside the housing 34 are a large parabolic reflector 36 and a plurality of layers 40, 42, 44 of LEDs with elliptical reflectors and/or parabolic reflectors. Light produced by the LEDs either passes directly through ends of the large parabolic reflector 36 or the large parabolic reflector 36 collimates light received from the elliptical reflectors.

Figure 2:
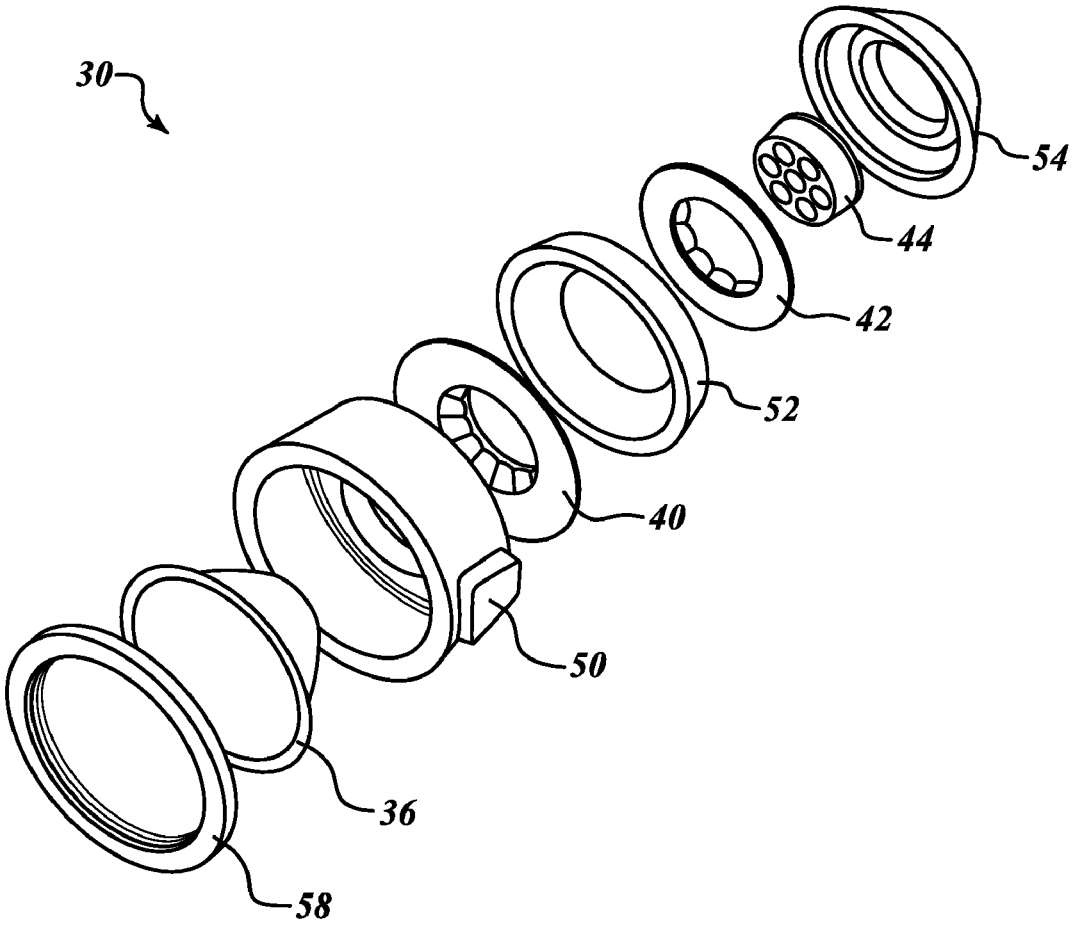
FIG. 2 illustrates an exploded view of the light assembly shown in FIG. 1.

FIG. 2 illustrates an exploded view of the light assembly 30. In this embodiment, the light assembly 30 includes three LED layers 40, 42, 44. The first and second LED layers 40, 42 are ring-shaped and the third layer LED layer 44 is sized to fit within an opening of the second LED layer 42. The first LED layer 40 is held in place within the housing 34 via a first housing section 50 and a second housing section 52. The second and third LED layers 42, 44 are held in place between the second housing section 52 and a third housing section 54. The various housing sections 50, 52, 54 are fastened together by suitable means (fasteners, adhesive and/or comparable materials) depending on the thermal, sealing or vibration requirements of the application. In one embodiment, the sections 50, 52, 54 are attached one to the next as the assembly is built with fasteners that provide significant clamp force to enhance thermal performance.

The lens 58 holds the parabolic reflector 36 within the first housing section 50. The lens 58 may attach to the first housing section 50 in a number of ways, for example threads on the first section 50 and the opposing surface of the lens 38 or an epoxy or other comparable fastener.

Figure 3:
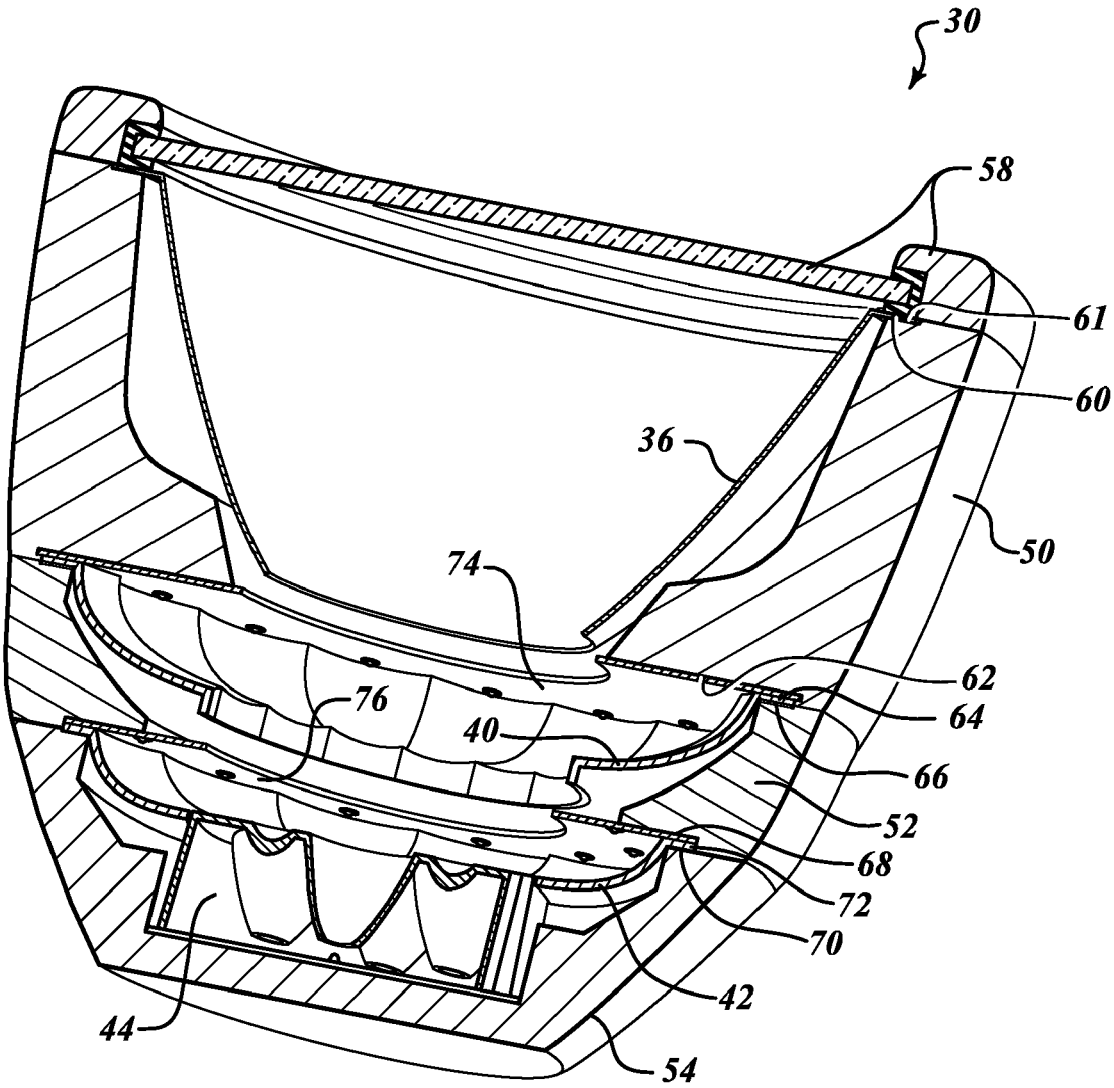
FIG. 3 is a cross-sectional view of the light assembly shown in FIG. 1.

FIG. 3 illustrates a cross-sectional view of the light assembly 30 shown in FIGS. 1 and 2. The parabolic reflector 36 includes first and second open ends. The first open end has a larger diameter than the second open end. The first open end includes an annular flange 60 that surrounds the opening. The flange 60 makes contact with an annular ledge 61 formed at the first open end of the first housing section 50. The lens 58, when attached to the first housing section 50, holds the parabolic reflector 36 in place by placing pressure on the flange 60. The parabolic reflector 36 rests within a cavity formed within the first housing section 50. The first housing section 50 also includes first and second open ends wherein the first open end has a slightly larger diameter than the first open end of the parabolic reflector 36 and the second open end has a slightly larger diameter than the second open end of the parabolic reflector 36.

A second ledge 62 formed on a bottom surface of the second open end of the housing section 50 supports an LED board 74 that is part of the first LED layer 40. The LED board 74 may be attached to the housing section 50 by fasteners or other comparable means. If metal fasteners (e.g. screws) are used then the housing section 50 acts as a heat sink to a metal layer within the LED board 74. The first LED layer 40 includes first and second open ends. The first open end includes an annular flange 64. The annular flange 64 and a portion of the LED board 74 securely sits between a first surface 66 of the second housing layer 52 and the second ledge 62. This allows the first LED layer 40 to sit securely within a cavity formed within the second housing section 52.

A similar type of slot is formed between a second surface 68 of the second housing section 52 and a first surface 70 of the third housing section 54. The slot formed between the second and third housing sections 52 and 54 receives an outer circumferential flange 72 of the second LED layer 42 and a portion of an LED board 76 of the third housing section 54. This allows the second LED layer 42 to sit securely within a portion of a cavity formed within the third housing section 54. The third housing section 54 also includes a second cavity portion that receives the third LED layer 44. A base of the third LED layer 44 is fastened to an interior base of the third housing section 54 using fastener(s), adhesives or comparable components.

Figures 1, 4:
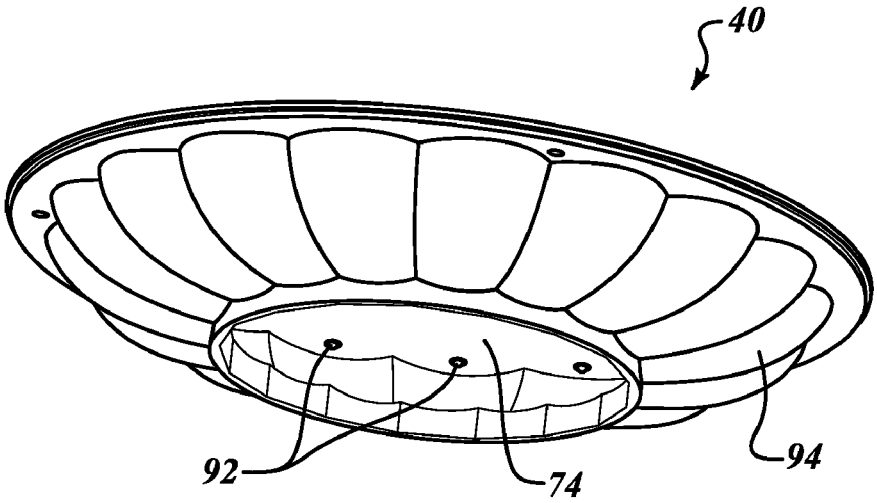
FIGS. 4-6 are perspective views of components of the light assembly shown in FIG. 1.
Figures 2, 4:
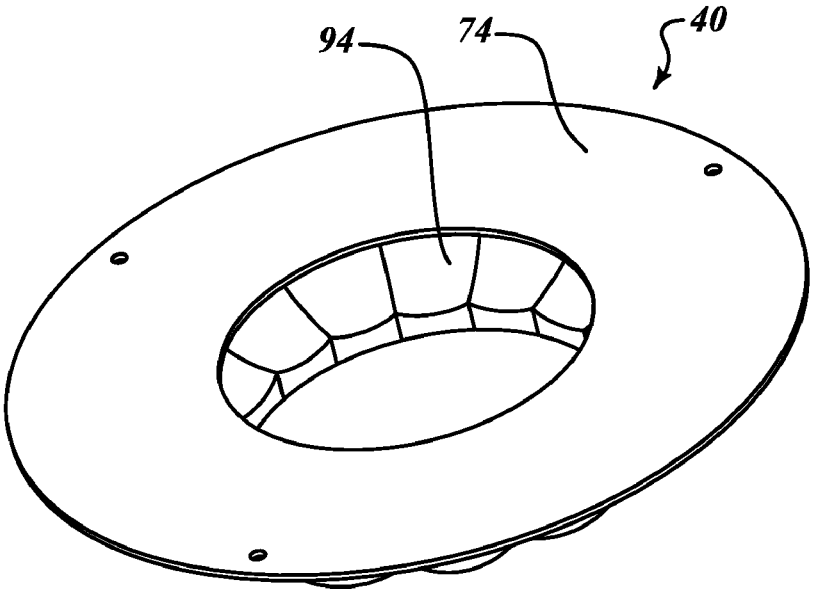

FIGS. 4-1 and 4-2 illustrate perspective views of the first LED layer 40. The first LED layer 40 includes the ring-shaped LED board 74 and a plurality of elliptical reflectors 94 mounted to a first side of the LED board 74. A plurality of LEDs 92 are also mounted to the first side of the LED board 74. The elliptical reflectors 94 are mounted such that a single elliptical reflector 94 is positioned around a corresponding single LED 92. The elliptical reflectors 94 are positioned such that light emanating from the LEDs 92 are reflected off of the elliptical reflectors 94 through the opening in the LED board 74. The light reflecting off the elliptical reflectors 94 reflects off of a predefined section of the parabolic reflector 36. This will be shown in more detail below with regard to FIG. 7. The elliptical reflectors 94 are attached to the LED board 74 (i.e., printed wiring board) by any number of techniques if the elliptical reflectors 94 are not sandwiched between the mated housing sections with a flexible adhesive. There is a keying feature included in the reflector to ensure proper registration with the LEDs for suitable focus.

Figures 1, 5:
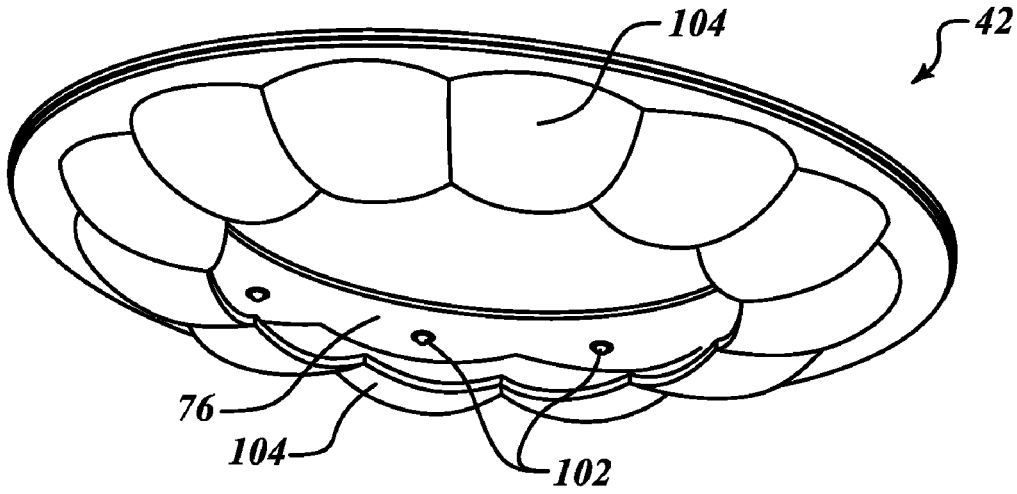
Figures 2, 5:
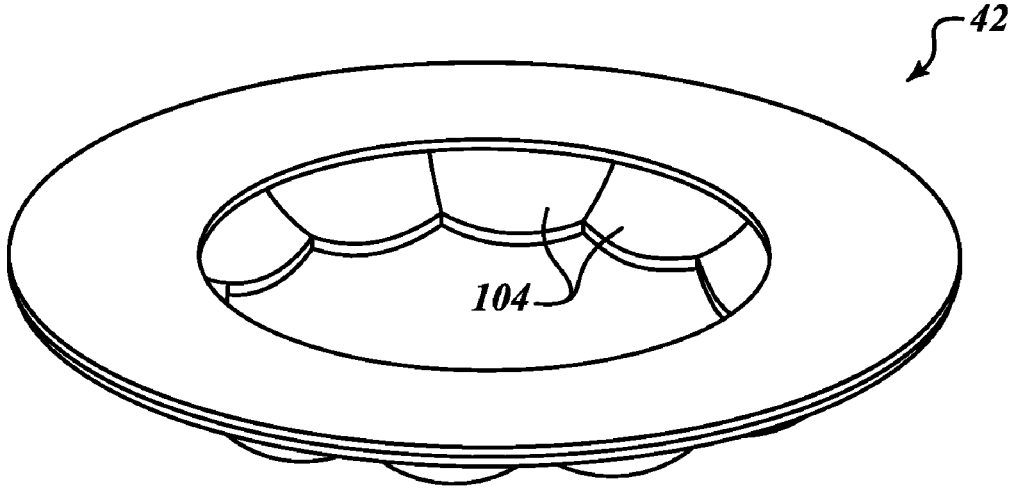

FIGS. 5-1 and 5-2 illustrate perspective views of the second LED layer 42. The second LED layer 42 includes a ring-shaped LED board 76 and a plurality of elliptical reflectors 104 mounted to a first side of the LED board 76. A plurality of LEDs 102 are also mounted to the first side of the LED board 76. The elliptical reflectors 104 are mounted such that a single elliptical reflector 104 is positioned around a corresponding single LED 102. The elliptical reflectors 104 are positioned such that light emanating from the LEDs 102 is reflected off of the elliptical reflectors 104 through the open end in the LED board 76. The light reflecting off the elliptical reflector 104 is then collimated by the parabolic reflector 36. This will be shown in more detail below with regard to FIG. 7.

Figures 1, 6:
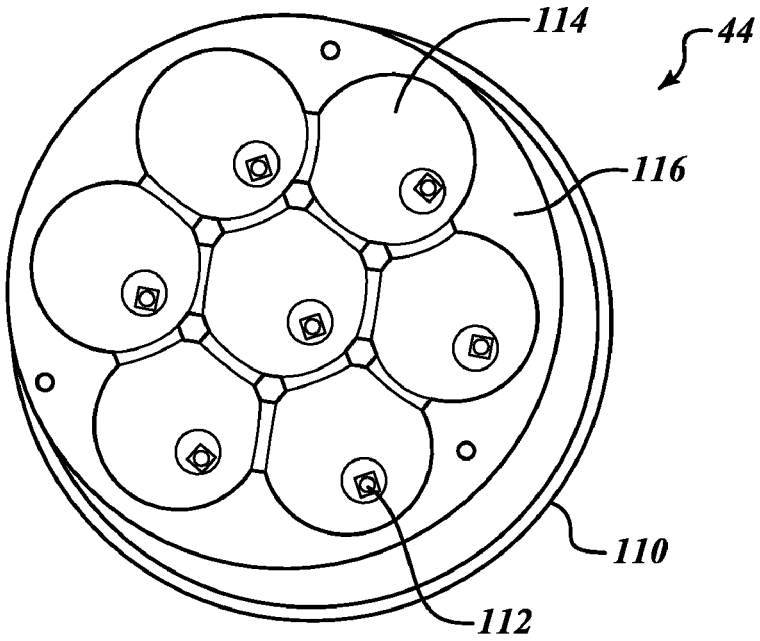
Figures 2, 6:
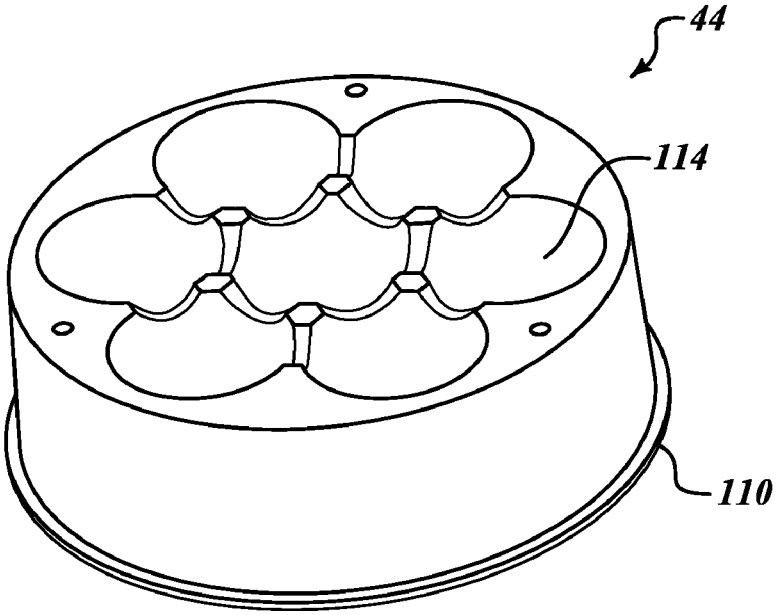

FIGS. 6-1 and 6-2 illustrate perspective views of the third LED layer 44. The third LED layer 44 includes an LED board 110, a plurality of LEDs 112 mounted to the LED board 110 and a multi-reflector unit 116 having a plurality of parabolic reflectors 114. Each of the parabolic reflectors 114 in the reflector unit 116 includes first and second open ends. The first open end has a larger diameter than the second open end. When the reflector unit 116 is mounted to the LED board 110, via fastener(s), epoxy or comparable means, the second open end is mounted adjacent to the LED board 110. The reflector unit 116 is mounted such that each of the LEDs 112 mounted on the LED board 110 are exposed via the second open end of a corresponding reflector 114. The third layer LED 44 includes parabolic reflectors instead of elliptical reflectors because the light emitted by the LEDs 112 is reflected directly through both open ends of the parabolic reflector 36 and do not reflect off of the parabolic reflector 36. This is shown in more detail in FIG. 7.

In one embodiment, the reflectors 94, 104, 114 are single units formed by a plastic injection molding process. The reflectors 94, 104, 114 are then coated with a reflective coating, such as, but not limited to, aluminum or silver. Other reflector devices may be used. For example, one or more of the parabolic reflectors 36, 114 may be an uncoated, reflective white plastic, such as that produced by Bayer. Also, the boards 74, 76, 110 may be printed circuit boards that include traces that electrically connect the LEDs 92, 102, 112 to wires or traces located on or embedded in the housing sections 50, 52, 54. In one embodiment, a wiring harness (not shown) connects to mounted headers (not shown) soldered onto the circuit boards at the time the LEDs are installed. A wiring routing channel and pocket (not shown) are included in each of the housing sections 50, 52, 54 to accommodate the wiring harness and mounted headers.

Figure 7:
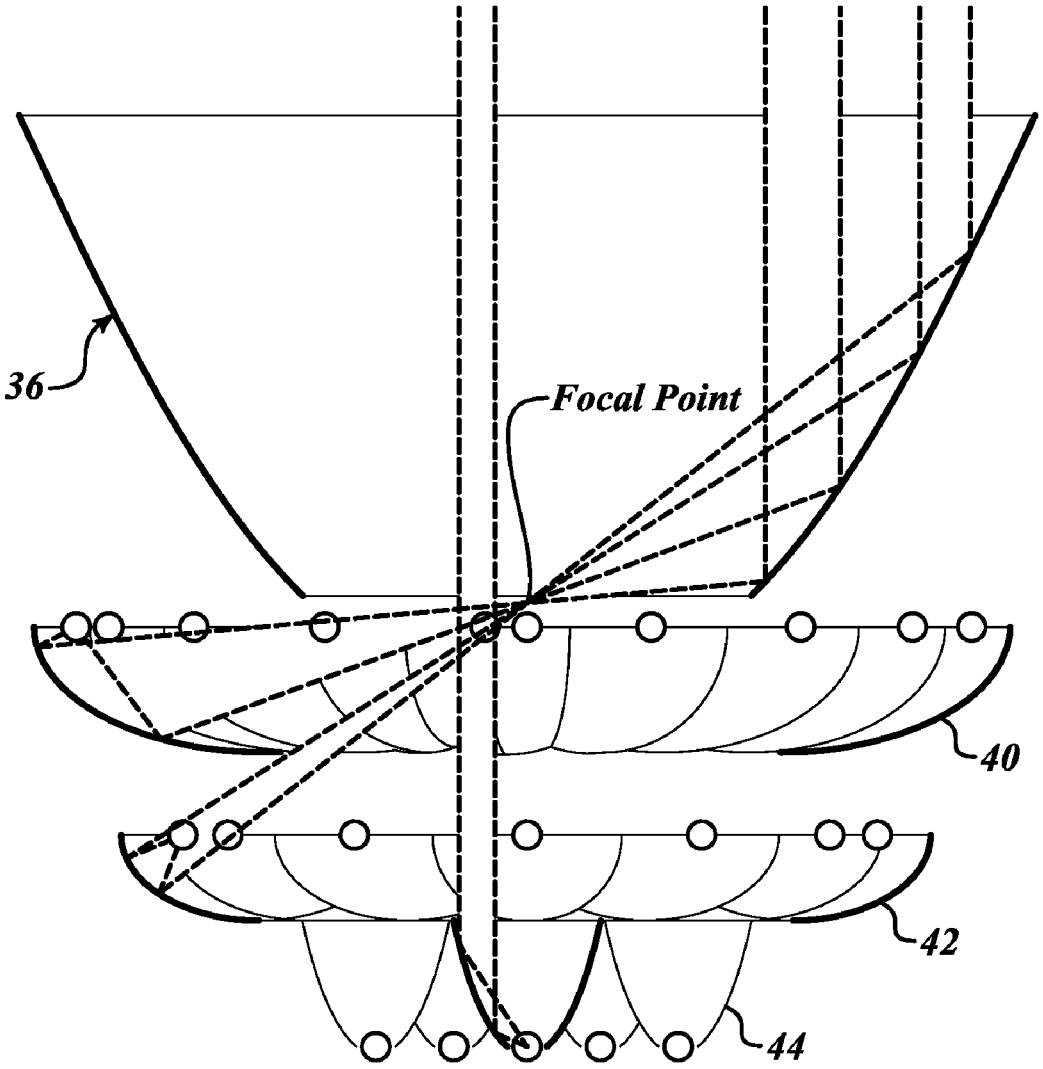
FIG. 7 is a wire diagram illustrating light production and reflection of the light assembly shown in FIG. 1.

As shown in FIG. 7, the light produced by the LEDS 112 reflects off the parabolic reflectors 114 of the third LED layer 44 and directly passes through the parabolic reflector 36. The elliptical reflectors 94, 104 of the first and second LED layers 40, 42 share a focal point with the parabolic reflector 36. Thus, the light produced by the first LED layer 40 reflects off a lower/aft section of the parabolic reflector 36 than does the light produced by the second LED layer 42.

In this example, the light assembly 30 produces light from approximately 37 LEDs with a high percentage of light produced by each LED being reflected either off of the parabolic reflector 36 or passing directly through the parabolic reflector 36 via its own parabolic reflector associated with the LED. In this example, the angular spread of light is approximately 11° to 12° with a production of over 700,000 candelas. Intensity and angular spread of light is adjustable by changing any number of variables: focal length of reflectors, number and type of LEDs, etc.

In another embodiment, different LED configurations may be used within the light assembly. The following are non-limiting examples of different LED configurations.

White and Infrared lights are included to produce both visual and non-visual light. In one embodiment, the LEDs used are all of a single color (red, amber, green, blue, etc.).

In one embodiment, the system includes different colored LEDs (red, green, blue, amber and/or white) distributed throughout the LED boards 74, 76, 110 with independent drive electronics (not shown) for producing variable color output. The drive electronics independently control the intensity of each color group, resulting in color mixing.

In one embodiment, the system is capable of providing variable temperature white. Similar to the aforementioned color mixing method, this embodiment is achieved through the appropriate location on the circuit boards (74, 76, 110) of groups of white LEDs selected from two specific "color" bins (a result of the LED manufacturing process) associated with "blackbody color temperatures" found close to, or along, the Planckian locus within a color space such as the CIE 1931 chromaticity diagram. Separate drive electronics control the intensity of each "color" bin of LEDs independently, thus providing the ability to vary the color temperature of the output light along a line between the two white endpoints defined by the selected LED "color" bins.

The addition of other white bin groups to the preceding method creates a color temperature polygon (triangle, rectangle, etc.), the boundaries of which are defined by the color points of the selected groups of colored LEDs. Varying the intensities of the component groups changes the output color temperature within the boundaries of the polygon.

Monochromatic LED groups, such as red, replace white in the previous embodiment for creating another color space polygon (triangle, rectangle, etc.), the boundaries of which will be defined by the color points of the selected groups of colored LEDs. Varying the intensities of the component groups changes the output color and color temperature within the boundaries of the polygon.

While the preferred embodiment of the invention has been illustrated and described, as noted above, many changes can be made without departing from the spirit and scope of the invention. For example, the device could include only two layers of LEDs with associated reflectors and those two layers could have only elliptical reflectors or one layer has elliptical reflectors and one layer includes parabolic reflectors. In another example, the device could include three or more LED and associated reflector "ring" layers. Further, one of the layers may include both elliptical and parabolic reflectors. Also, in one example the parabolic reflector 36 is replaced with a non-parabolic type reflector. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A light assembly comprising:

a housing having a longitudinal axis, the housing comprising only a single end configured to emit light;

a first layer of light emitting diodes (LEDs) located at a first position on the longitudinal axis within the housing;

a second layer of LEDs located at a second position on the longitudinal axis within the housing; and a parabolic reflector located at a light emitting end of the housing, wherein each of the layers comprises a plurality of optical reflectors, wherein the longitudinal axis is approximately perpendicular to a plane of the light emitting end of the housing, wherein the first layer of LEDs comprises a plurality of elliptical reflectors, a board and a plurality of LEDs, wherein the LEDs are mounted to the board and the elliptical reflectors are positioned such that they receive light produced by the corresponding LED and reflect the received light onto the inner surface of the parabolic reflector.

2. The assembly of claim 1, wherein the LEDs comprise two groups of white LEDs of different correlated color temperatures, further comprising drive components configured to independently drive the groups of LEDs in order to produce a temperature effect.

3. The assembly of claim 1, wherein the LEDs comprise at least one Infrared LED.

4. The assembly of claim 1, wherein the LEDs comprise LEDs of a plurality of wavelength bandwidths.

5. The assembly of claim 4, further comprising drive components configured to independently drive the LEDs of different wavelength bandwidths in order to vary intensity and color output.

6. The assembly of claim 1, wherein the second layer of LEDs comprises a plurality of parabolic reflectors, a second board and a second plurality of LEDs, wherein the second plurality of LEDs are mounted to the second board and the parabolic reflectors are positioned to reflect light produced by the second plurality of LEDs through the light producing end of the housing.

7. The assembly of claim 6, wherein the elliptical and parabolic reflectors share a common focal point.

8. The assembly of claim 6, further comprising one or more additional layers of LEDs, wherein each of the one or more additional layers of LEDs comprises a circuit board, a plurality of LEDs, and a plurality of elliptical reflectors, wherein the plurality of LEDs of the one or more additional layers of LEDs are mounted to the associated board and the associated plurality of elliptical reflectors are positioned such that they receive light produced by the respective plurality of LEDs and reflect the received light onto the inner surface of the parabolic reflector.

9. The assembly of claim 8, wherein the LEDs of the first layer and one or more additional layers of LEDs are located at approximately a focal point of the respective elliptical reflectors.

10. A light assembly comprising:

a housing having a longitudinal axis;

a first layer of light emitting diodes (LEDs) located at a first position on the longitudinal axis within the housing; and a second layer of LEDs located at a second position on the longitudinal axis within the housing, wherein each of the layers comprises a plurality of optical reflectors;

a parabolic reflector located at a light emitting end of the housing, wherein the first layer of LEDs comprises:

a plurality of elliptical reflectors;

a board; and a plurality of LEDs, wherein the LEDs are mounted to the board and the elliptical reflectors are positioned such that they receive light produced by the corresponding LED and reflect the received light onto the inner surface of the parabolic reflector, wherein the second layer of LEDs comprises:

a plurality of parabolic reflectors;

a second board; and a second plurality of LEDs, wherein the second plurality of LEDs are mounted to the second board and the parabolic reflectors are positioned to reflect light produced by the second plurality of LEDs through the light producing end of the housing.

11. A light producing method comprising:

generating light from a first layer of light emitting diodes (LEDs) located at a first position on a longitudinal axis within a housing;

generating light from a second layer of LEDs located at a second position on the longitudinal axis within the housing;

elliptically reflecting light produced by at least one of the first or second plurality of LEDs;

collimating light generated by at least one of the first or second layers of LED;

wherein the collimated light leaves the housing at only a single end, wherein the longitudinal axis is approximately perpendicular to a plane of the single end of the housing, wherein the elliptically reflecting light is produced by a plurality of elliptical reflectors and the collimated light is produced by a parabolic reflector, wherein the elliptical reflectors and the parabolic reflector share a common focal point.

12. The method of claim 11, wherein generating light from at least one of the layers of LEDs comprises generating light from two groups of white LEDs of different correlated color temperatures, further comprising independently driving the two groups of LEDs in order to produce a temperature effect.

13. The method of claim 11, further comprising generating light from one or more additional layers of LEDs located at one or more other positions on the longitudinal axis within the housing.

14. The method of claim 13, further comprising elliptically reflecting the light generated by LEDs included in the one or more additional layers of LEDs; and collimating the light generated by LEDs included in the one or more additional layers of LEDs.

15. The method of claim 11, wherein generating light from at least one of the layers of LEDs comprises generating light of a plurality of wavelength bandwidths.

16. The method of claim 15, further comprising independently driving the different colored LEDs in order to output variable colors.

* * * * *